US005792973A

United States Patent [19]

Riboloff

[11] Patent Number: 5,792,973

[45] Date of Patent: Aug. 11, 1998

[54] PICKUP FOR STRINGED MUSICAL INSTRUMENT

[75] Inventor: John T. Riboloff, Antioch, Tenn.

[73] Assignee: Gibson Guitar Corp., Nashville, Tenn.

[21] Appl. No.: 781,729

[22] Filed: Jan. 10, 1997

[51] Int. Cl.[6] ..... G10H 3/18

[52] U.S. Cl. ..... 84/726

[58] Field of Search ..... 84/726–728

[56] References Cited

U.S. PATENT DOCUMENTS

| | | | |
|---|---|---|---|
| 3,571,483 | 3/1971 | Davidson | 84/726 |
| 3,725,561 | 4/1973 | Paul | 84/1.15 |
| 3,902,394 | 9/1975 | Stich | 84/1.15 |
| 3,915,048 | 10/1975 | Stich | 84/1.14 |
| 3,916,751 | 11/1975 | Stich | 84/1.15 |
| 4,026,178 | 5/1977 | Fuller | 84/1.16 |
| 4,151,776 | 5/1979 | Stich | 84/1.16 |
| 4,164,163 | 8/1979 | Rhodes | 84/1.15 |
| 4,319,510 | 3/1982 | Fender | 84/1.15 |
| 4,408,513 | 10/1983 | Clevinger | 84/1.15 |
| 4,499,809 | 2/1985 | Clevinger | 84/1.15 |
| 4,581,974 | 4/1986 | Fender | 84/1.15 |
| 4,581,975 | 4/1986 | Fender | 84/1.15 |
| 4,686,881 | 8/1987 | Fender | 84/727 |
| 5,136,918 | 8/1992 | Riboloff | 84/723 |
| 5,136,919 | 8/1992 | Wolstein | 84/742 |
| 5,221,805 | 6/1993 | Lace | 84/726 |
| 5,311,806 | 5/1994 | Riboloff | 84/728 |
| 5,376,754 | 12/1994 | Stich | 84/728 |
| 5,408,043 | 4/1995 | Lace | 84/726 |
| 5,438,158 | 8/1995 | Riboloff | 84/727 |

*Primary Examiner*—Stanley J. Witkowski
*Attorney, Agent, or Firm*—McAfee & Taft

[57] ABSTRACT

A pickup for a musical instrument having a body to which strings are connected includes a winding to conduct an electrical signal generated in response to movement of at least one of the strings of the musical instrument when the pickup is connected to the body of the musical instrument. The pickup also includes a magnet disposed with the winding such that the winding is between the magnet and the body of the musical instrument when the pickup is connected to the body of the musical instrument and further such that the magnet is between the winding and the strings when the pickup is connected to the body of the musical instrument.

22 Claims, 2 Drawing Sheets

PICKUP FOR STRINGED MUSICAL INSTRUMENT

BACKGROUND OF THE INVENTION

This invention relates generally to pickups for stringed musical instruments and more particularly, but not by way of limitation, to electromagnetic pickups for electric guitars.

One technique for amplifying the sound of a stringed musical instrument uses electromagnetic pickups positioned beneath the strings of the instrument. Such pickups include one or more coils or windings of wire wrapped around one or more metallic cores or pole pieces which are themselves magnetic or which are magnetized by adjacent magnetic material. The strings of the instrument pass through the magnetic field and cause an electrical signal to be produced in the winding(s) when the strings vibrate within the magnetic field in response to being played. The produced electrical signals correspond to the notes played on the strings, and the electrical signals are electrically amplified and broadcast to create the amplified audible music.

One way to affect the nature of the electrical signals, and thus one way to affect the tone of the sound generated from the electrical signals, is by the design of the electromagnetic pickup. For example, a single-coil pickup produces a different sound than a dual-coil humbucking pickup. Such differences are significant because particular musicians or particular music may call for particular sounds that are obtained from different types of pickups.

The field of designing pickups for musical instruments is thus still active, and so there is the need for new types of pickups that produce their own unique tonality.

SUMMARY OF THE INVENTION

The present invention meets the above-noted and other needs by providing a novel and improved pickup for a musical instrument. The present invention provides a pickup that produces a relatively smooth tonality (i.e., one that reduces harsh frequency peaks).

The pickup of the present invention is for a musical instrument having a body to which strings are connected. The pickup comprises a winding to conduct an electrical signal generated in response to movement of at least one of the strings of the musical instrument when the pickup is connected to the body of the musical instrument. The pickup further comprises a magnet disposed with the winding such that the winding is between the magnet and the body of the musical instrument when the pickup is connected to the body of the musical instrument and further such that the magnet is between the winding and the strings when the pickup is connected to the body of the musical instrument.

The pickup can be more particularly defined as comprising: primary magnetic field means for defining a primary magnetic field; two electrical conductor windings disposed within the primary magnetic field; and secondary magnetic field means disposed adjacent the windings within the primary magnetic field for providing a secondary magnetic field to cause a different electrical signal to be generated and to be conducted by the windings in response to movement of at least one of the strings of the musical instrument than an electrical signal which would be generated in response to movement of the at least one string in the primary magnetic field alone.

Therefore, from the foregoing, it is a general object of the present invention to provide a novel and improved pickup for a musical instrument. Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
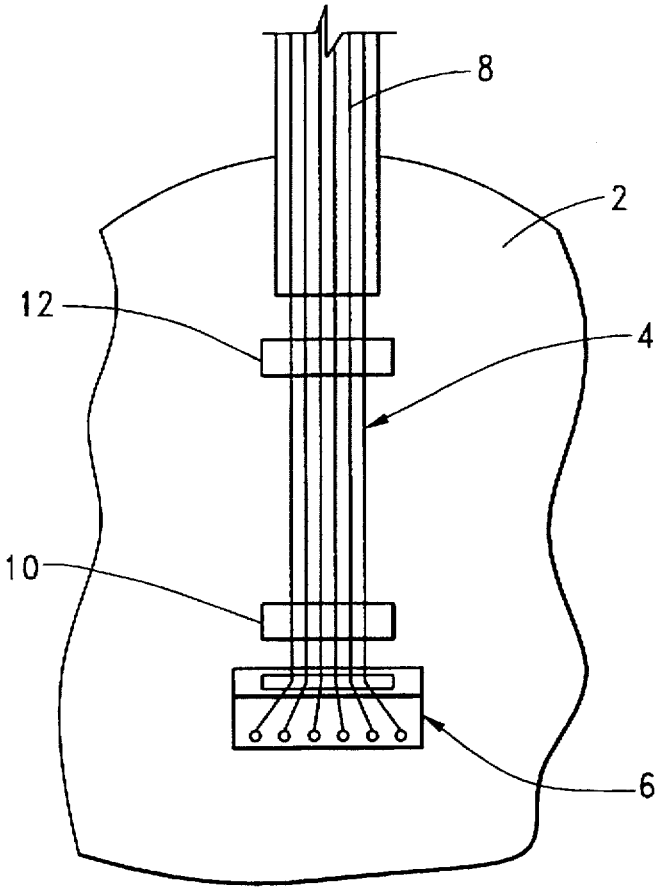
FIG. 1 is a representation of a part of a stringed musical instrument, such as an electric guitar, with which the present invention can be used.

The present invention can be used with any stringed musical instrument 2, as partially represented in FIG. 1, for which electrical amplification is desired. The preferred embodiment of the invention is particularly adapted for use with an electric guitar.

The illustrated instrument 2 has six strings 4, but more or less may be used on various types of musical instruments or different embodiments of a particular type of instrument. The strings 4 are anchored at their lower end (as viewed in FIG. 1) in conventional manner near a bridge 6 mounted on the body of the instrument 2, and they are connected at their upper ends to tuning screws (not shown) located at the upper end of a fingerboard 8 attached to or integrally formed with the main body of the instrument.

Figure 3:
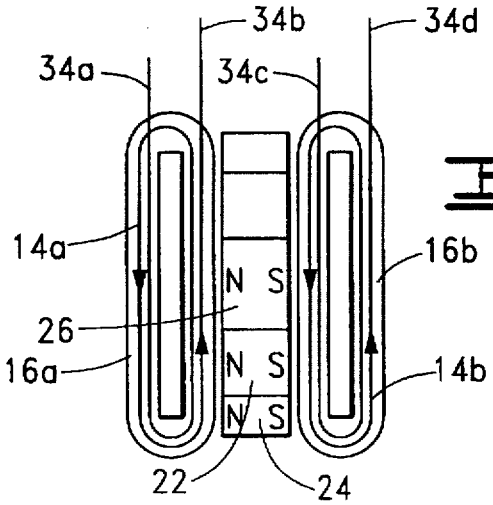
FIG. 3 is a plan view of the implementation of FIG. 2 but showing only the two windings (laterally spaced from their assembled positions) and the vertically arrayed magnets.
Figure 2:
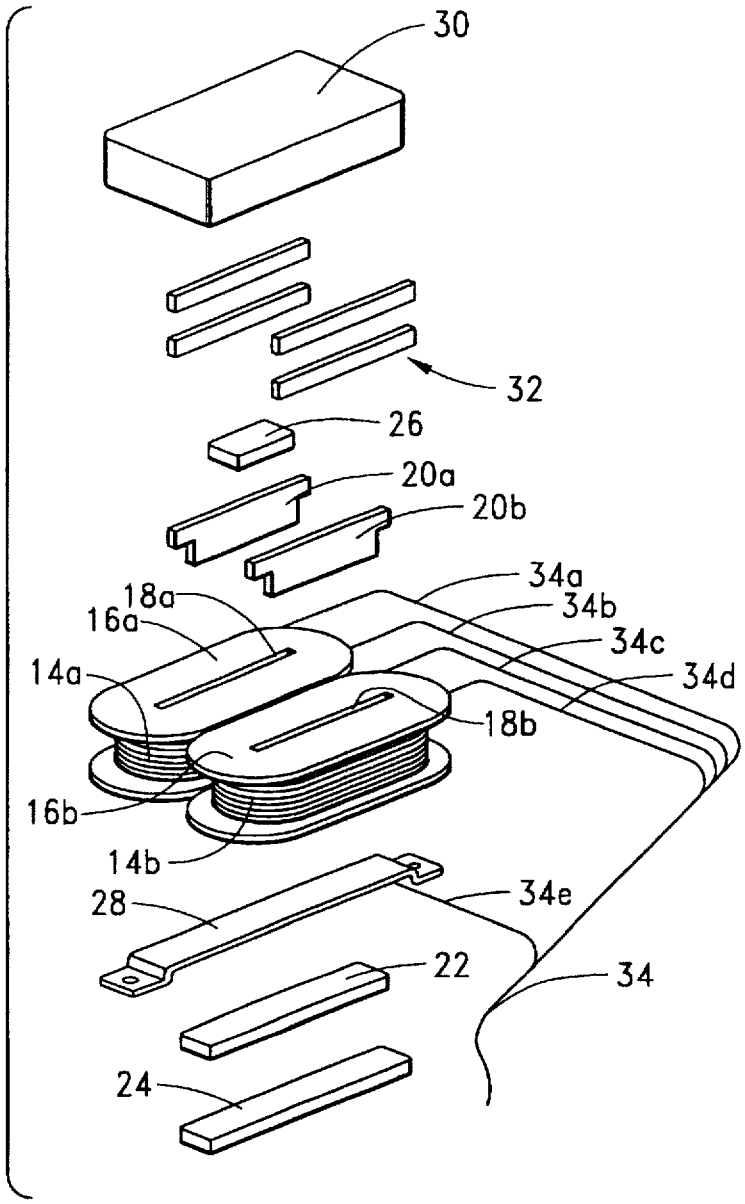
FIG. 2 is an exploded view of a particular implementation of the pickup of the present invention.

Mounted on and within the instrument 2 in a conventional manner is a pickup system. The pickup system represented in FIG. 1 includes two pickups 10, 12; however, in general one or more pickups can be used. Any one or more of the pickups can be constructed in accordance with the present invention. A particular implementation of one such pickup is shown in FIGS. 2 and 3.

The pickup of the present invention, such as can be used as either pickup 10 or pickup 12 or both, includes one or more electrical conductors suitable to conduct an electrical signal generated in response to movement of at least one of the strings 4 of the musical instrument 2 when the pickup of the present invention is connected to the body of the musical instrument. In the implementation of FIGS. 2 and 3, there are two such electrical conductors **14*a*, 14*b* wound around respective coil forms 16*a*, 16*b* to define coils or windings of the pickup. In a particular implementation, each of the windings is formed by 6,900 turns of a respective 44 AWG gauge magnet wire. As shown in FIGS. 2 and 3, each of these coils or windings has an elongated shape with a diametric type length perpendicular to the axis about which the coils are wound. Such axis is oriented substantially vertically in the orientation of FIG. 2. In this orientation, something above the windings as oriented in FIG. 2 can be said to be on one side of the winding and something below can be said to be on another, opposite side of the winding. Although two windings are shown in FIGS. 2 and 3**, the present invention can be used with one or more windings.

Each of the coil forms 16 is made of a suitable material known in the art (e.g., plastic), and each has a respective axial slot 18 which receives one or more pole pieces. In the implementation of FIGS. 2 and 3, there is one pole piece 20 for each slot 18 (i.e., pole piece **20*a* for slot 18*a*, and pole piece 20***b* for slot 18*b*). Each pole piece 20 has a substantially rectangular shape with retaining ears or protuberances extending therefrom as shown in FIG. 2. Each pole piece 20 is received in a respective one of the slots 18 such that the lower (as oriented in FIG. 2) edge can contact a body adjacent the lower side of the respective coil or winding. Each pole piece 20 also has an upper edge disposed such that it can contact an object adjacent the upper side of the coil or winding. Each pole piece 20 is disposed within the circumference of the respective coil or winding. Each pole piece of a particular implementation is a non-permanent magnet, but magnetically conductive steel blade.

Disposed beneath (as oriented in FIG. 2) the windings formed by the wires 14 is primary magnetic field means for defining a primary magnetic field. In the illustrated implementation, this includes two vertically stacked permanent magnets 22, 24. The magnet 22 is shorter than the magnet 24, and the magnet 22 is disposed between the lower side of the windings and the upper surface of the magnet 24. The magnet 22 contacts the lower edges of the pole pieces 20*a*, 20*b* which extend below the coil forms 16*a*, 16*b*. In a particular implementation, the magnet 22 is a Ceramic VIII magnet, and the magnet 24 is an ALNICO II magnet; however, any other suitable types of magnets can be used. In the preferred embodiment, the polarities of the magnets 22, 24 are aligned such that the north poles of each magnet are both oriented along one edge of the vertically stacked magnets and the south pole is along the other edge.

Located on the opposite side of the windings is a secondary magnetic field means disposed adjacent the windings within the primary magnetic field. The secondary magnetic field means provides a secondary magnetic field to cause a different electrical signal to be generated and to be conducted by the conductors of the windings in response to movement of at least one of the strings of the musical instrument. This signal is different (e.g., a reduction in harsh frequency peaks) from an electrical signal that would be generated in response to movement of the at least one string in the primary magnetic field alone. This secondary magnetic field means includes a permanent magnet 26 disposed adjacent the upper (as oriented in FIG. 2) side of the windings in contact with the upper edges of the pole pieces 20*a*, 20*b*. This places the windings between the magnet 26 and the separate and distinct magnets 22, 24. This also places the windings between the magnet 26 and the body of the musical instrument when the pickup is connected to the body. Still further, this places the magnet 26 between the windings and the strings when the pickup is connected to the body of the musical instrument. In the illustrated embodiment, the polarity of the magnet 26 is oriented the same as the polarities of the magnets 22, 24, whereby the north poles are aligned along the same edge and the south poles are aligned along the same edge.

So that the magnet 26 has the desired effect of creating a smoother tonality than is obtained without it, the magnet 26 has a length about one-third the length of the windings. More particularly, the magnet 26 has a length about one-third the length of one of the blade-type pole pieces 20. With regard to conventional sizes of pickups, the magnet 26 preferably has a length within the range between about one-half inch and about one inch. As clearly shown in FIG. 3, the length of the magnet 26 is shorter than the length of the magnet 22, which itself is shorter than the length of the magnet 24. It is to be noted that the view shown in FIG. 3 shows the relationship of these three magnets with the two coils or windings shifted laterally from where they would actually be. That is, in the assembled pickup, the coils or windings of wires 14*a*, 14*b* are laterally adjacent each other and vertically between the magnet 26 and the paired, vertically stacked magnets 22, 24.

The length of the magnet 26 is considered to be the more significant dimension of this magnet; however, it is preferred that, for a conventional size of pickup, the width of the magnet 26 be about three-eighth inch or about one-half inch. A specific implementation of the magnet 26 is an ALNICO II magnet having a width of about one-half inch and a length of about seven-eighth inch and a thickness of about one-eighth inch.

The pickup further includes a base 28 by which the pickup is connected to the musical instrument. The base 28 is retained between the lower portions of the pole pieces 20*a*, 20*b* and between the coil forms 16*a*, 16*b* and the magnet 22. The pickup also includes a cover 30 having a cavity in which the aforementioned components are received. Spacers 32 are used to maintain the elements in appropriate orientation. The base 28 and the cover 30 are preferably made of non-magnetic material (e.g., brass or nickel silver), and the spacers 32 are preferably made of a suitable wood or plastic. These are used in a conventional manner known in the art.

The pickup also includes means for connecting each of the windings to an electrical circuit. In the illustrated embodiment this includes a shielded four-conductor cable 34. Conductors 34*a*, 34*b* are connected to the two ends of the wire 14*a* forming one of the windings, and conductors 34*c*, 34*d* are connected to the ends of the wire 14*b* forming the other illustrated winding. Shield 34*e* of the cable 34 is connected to the base 28 as shown in FIG. 2 (and preferably also to the cover 30). The other end of the cable 34 connects to the remainder (if any) of the pickup system mounted on the musical instrument 2, or it connects to a jack or other suitable means by which the electrical signals are conducted away from the instrument, such as to a preamplifier or amplifier circuit. In general, the cable 34 allows one to choose how to link the coils or windings, but the details or possibilities of such choices are not part of the present invention.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A pickup for a musical instrument having a body to which strings are connected, comprising:

a winding to conduct an electrical signal generated in response to movement of at least one of the strings of the musical instrument when said pickup is connected to the body of the musical instrument; and a permanent magnet disposed with said winding such that said winding is between the entirety of said magnet and the body of the musical instrument when said pickup is connected to the body of the musical instrument and further such that said magnet is entirely between said winding and the strings when said pickup is connected to the body of the musical instrument, wherein said magnet has a length within the range between about one-half inch and about one inch.

2. A pickup as defined in claim 1, wherein said magnet has a length about one-third the length of said winding.

3. A pickup as defined in claim 1, wherein:

said pickup further comprises a second winding disposed next to said first-mentioned winding; and said magnet is disposed adjacent both said windings.

4. A pickup as defined in claim 2, wherein said magnet has a width of about one-half inch, a length of about seven-eighth inch and a thickness of about one-eighth inch.

5. A pickup for a musical instrument having a body to which strings are connected, comprising:

a winding to conduct an electrical signal generated in response to movement of at least one of the strings of the musical instrument when said pickup is connected to the body of the musical instrument;

a pole piece disposed within the circumference of said winding and having a length measured parallel to the largest diameter of said winding; and a permanent magnet disposed with said winding and in contact with said pole piece such that said winding and pole piece are between the entirety of said magnet and the body of the musical instrument when said pickup is connected to the body of the musical instrument and further such that said magnet is entirely between said winding and the strings when said pickup is connected to the body of the musical instrument, wherein said magnet has a length about one-third the length of said pole piece.

6. A pickup as defined in claim 5, wherein:

said pickup further comprises:

a second winding disposed next to said first-mentioned winding; and a second pole piece, disposed within the circumference of said second winding; and said magnet contacts said first and second pole pieces.

7. A pickup as defined in claim 6, wherein each of said pole pieces includes a respective metallic blade and wherein said magnet has a length about one-third the length of one of said blades.

8. A pickup as defined in claim 5, wherein said magnet has a length within the range between about one-half inch and about one inch.

9. A pickup as defined in claim 6, further comprising a second magnet, said second magnet disposed such that said windings are between said first-mentioned magnet and said second magnet.

10. A pickup as defined in claim 9, further comprising a third magnet, said third magnet disposed such that said second magnet is between said windings and said third magnet.

11. A pickup as defined in claim 10, wherein said first-mentioned magnet is shorter than said second magnet and said second magnet is shorter than said third magnet.

12. A pickup as defined in claim 11, wherein said first-mentioned magnet has a length within the range between about one-half inch and about one inch.

13. A pickup as defined in claim 10, wherein the polarities of said second magnet and said third magnet are transverse to the lengths and thicknesses of said second magnet and said third magnet and are aligned such that the north pole of said second magnet and the north pole of said third magnet are both oriented along corresponding longitudinal edges of the second and third magnets and the south poles thereof are oriented along the opposite longitudinal edges thereof.

14. A pickup as defined in claim 11, wherein the polarities of said second magnet and said third magnet are transverse to the lengths and thicknesses of said second magnet and said third magnet and are aligned such that the north pole of said second magnet and the north pole of said third magnet are both oriented along corresponding longitudinal edges of the second and third magnets and the south poles thereof are oriented along the opposite longitudinal edges thereof.

15. A pickup for a stringed musical instrument, comprising:

an electrical conductor winding having first and second sides axially spaced from each other and disposed such that the first side is closer to strings of the instrument than is the second side when said pickup is mounted on the instrument, wherein said winding has a length extending transverse to the strings of the instrument when said pickup is mounted on the instrument;

a first flat permanent magnet having two opposing longitudinal edges extending along the length of said first magnet, said first magnet disposed on the first side of said winding such that the longitudinal edges of said first magnet are parallel to the length of said winding; and a second flat permanent magnet having two opposing longitudinal edges extending along the length of said second magnet, said second magnet disposed on the second side of said winding such that the longitudinal edges of said second magnet are parallel to the length of said winding, wherein the north pole of said first magnet is along one of the longitudinal edges of said first magnet and the north pole of said second magnet is along one of the longitudinal edges of said second magnet and the north poles of said first and second magnets are aligned one above the other on opposite sides of said winding and wherein the south poles of said first and second magnets are likewise aligned along the respective other longitudinal edges of said first and second magnets.

16. A pickup as defined in claim 15, further comprising:

a metallic member disposed through said winding in contact with said first magnet and said second magnet;

means for connecting said pickup to the musical instrument; and means for connecting said winding to an electrical circuit.

17. A pickup as defined in claim 16, wherein said first magnet has a length within the range between about one-half inch and about one inch.

18. A pickup as defined in claim 17, further comprising a third flat permanent magnet, disposed on the second side of said winding in vertically stacked arrangement with said second magnet such that said second and third magnets are adjacent each other with their respective polarities aligned.

19. A pickup as defined in claim 18, wherein said first magnet is shorter than said second magnet, and said second magnet is shorter than said third magnet.

20. A pickup as defined in claim 19, further comprising a second electrical conductor winding disposed adjacent said first-mentioned winding.

21. A pickup as defined in claim 15, wherein said first magnet has a length about one-third the length of said winding.

22. A pickup as defined in claim 15, wherein said first magnet has a length within the range between about one-half inch and about one inch.

* * * * *